US008091741B2

(12) United States Patent
Pritchard

(10) Patent No.: US 8,091,741 B2
(45) Date of Patent: Jan. 10, 2012

(54) FLUID DISPENSER

(76) Inventor: Michael Pritchard, Suffolk (GB)

( * ) Notice: Subject to any disclaimer, the term of this patent is extended or adjusted under 35 U.S.C. 154(b) by 597 days.

(21) Appl. No.: 12/240,664

(22) Filed: Sep. 29, 2008

(65) Prior Publication Data

US 2009/0071983 A1 Mar. 19, 2009

Related U.S. Application Data

(63) Continuation-in-part of application No. 12/294,426, filed as application No. PCT/GB2007/003623 on Sep. 25, 2007.

(51) Int. Cl.
*B67B 7/76* (2006.01)

(52) U.S. Cl. ..... 222/189.1; 222/211; 222/321.4; 222/321.7; 222/382; 222/383.1; 222/402.18; 222/464.2; 222/464.3

(58) Field of Classification Search ..... 222/189.1, 222/206, 209, 211–215, 189.11, 382, 383.1, 222/633, 635, 464.1, 527, 464.2, 533, 464.3, 222/535, 402.1, 402.19, 402.22, 402.23, 222/402.18, 321.4, 376, 321.7
See application file for complete search history.

(56) References Cited

U.S. PATENT DOCUMENTS

| | | | | | |
|---|---|---|---|---|---|
| 2,681,252 | A | * | 6/1954 | Tuttle | 222/187 |
| 3,184,118 | A | * | 5/1965 | Webster | 222/189.1 |
| 3,209,954 | A | * | 10/1965 | Webster | 222/189.1 |
| 3,260,421 | A | * | 7/1966 | Rabussier | 222/402.18 |
| 3,785,537 | A | * | 1/1974 | Appleby et al. | 222/464.2 |
| 3,788,521 | A | * | 1/1974 | Laauwe | 222/94 |
| 4,142,652 | A | * | 3/1979 | Platt | 222/402.2 |
| 4,398,654 | A | * | 8/1983 | Pong et al. | 222/402.1 |
| 4,418,846 | A | * | 12/1983 | Pong et al. | 222/189.1 |
| 4,530,450 | A | * | 7/1985 | Nandagiri | 222/402.1 |
| 5,397,034 | A | * | 3/1995 | Wunsch | 222/333 |
| 5,520,310 | A | * | 5/1996 | Bauer et al. | 222/402.2 |
| 5,552,046 | A | | 9/1996 | Johnston et al. | |
| 5,875,933 | A | * | 3/1999 | Ellion et al. | 222/189.1 |
| 5,897,032 | A | * | 4/1999 | Ellion et al. | 222/189.1 |
| 6,379,544 | B1 | | 4/2002 | Chen | |
| 6,605,060 | B1 | * | 8/2003 | O'Neil | 604/152 |
| 6,820,769 | B2 | * | 11/2004 | Foster et al. | 222/153.13 |

FOREIGN PATENT DOCUMENTS

| | | | |
|---|---|---|---|
| EP | 0445989 | A | 9/1991 |
| WO | 2006021966 | A | 3/2006 |

* cited by examiner

*Primary Examiner* — Frederick C. Nocolas
(74) *Attorney, Agent, or Firm* — Kenyon & Kenyon LLP

(57) ABSTRACT

In the present invention we replace a standard dip tube in a fluid dispenser with a hollow fiber membrane that passes liquid in preference to gas. Under the influence of a pressure differential, any liquid in contact with any portion of the hollow fiber membrane passes through the wall of the membrane and travels internally along the length of the membrane to a dispenser head. The fluid dispenser is thereby capable of operating in substantially any orientation and is effective to dispense substantially its entire contents.

18 Claims, 5 Drawing Sheets

FLUID DISPENSER

CROSS-REFERENCE TO RELATED APPLICATIONS

The present application is a continuation in part of U.S. application Ser. No. 12/294,426, filed Sep. 24, 2008, entitled "Fluid Delivery Device". The contents of that application are incorporated by reference herein.

BACKGROUND TO THE INVENTION

Spray dispensers are used in many different applications including kitchen products, perfumes, deodorants and anti-perspirants, spray paints, atomisers, inhalers, hair products, liquid/foam/gel products, pesticides, herbicides and insecticides. There are of course many others.

Traditional spray dispensers suffer from two inconvenient design flaws associated with the use of a standard "dip tube" to extract fluid, namely they are generally incapable of working regardless of the orientation of the dispenser body and it is virtually impossible to remove the entire contents. These two fundamental problems have existed since spray dispensers were first invented.

SUMMARY OF THE INVENTION

In the present invention we replace a standard dip tube in a fluid dispenser with a hollow fibre membrane that passes liquid in preference to gas. Under the influence of a pressure differential, any liquid in contact with any portion of the hollow fibre membrane passes through the wall of the membrane and travels internally along the length of the membrane to a dispenser head.

The fluid dispenser may be self-pressurised or may instead rely on the dispenser head or external pressure applied to the body of the dispenser to establish the necessary pressure differential.

Typical dispenser heads known in the art include trigger spays, atomisers, aerosol sprayers, perfume sprayers, lotion pumps, inhalers, foam pumps and screw micro pumps.

The fluid dispenser head may eject fluid as a spray, stream, foam, fine-mist or gel.

BRIEF DESCRIPTION OF THE DRAWINGS

Examples of the present invention will now be described in detail with reference to the accompanying drawings, in which.

DETAILED DESCRIPTION

Figure 1:
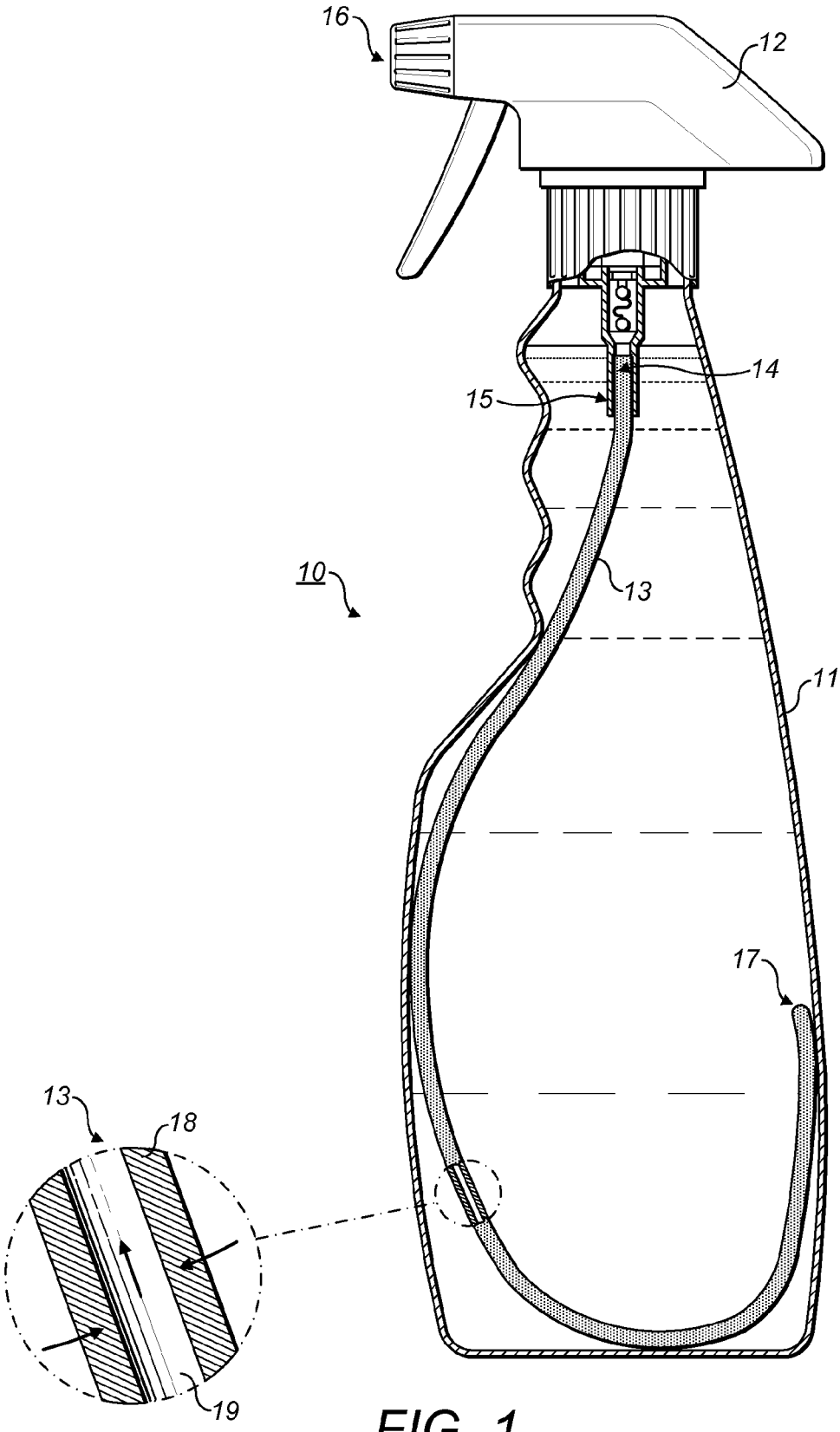
FIG. 1 shows an example of a trigger spray.

FIG. 1 shows an example of a fluid dispenser 10 in accordance with the present invention. The fluid dispenser 10 has a hollow plastics bottle 11 fitted with a conventional trigger spray dispenser head 12. The fluid dispenser 10 includes a dip tube 13 formed from a length of hollow membrane, the hollow membrane having an open end 14 which is coupled to a fluid port 15 in the trigger spray head 12 so as to be able to communicate with the outlet 16 of the trigger spray head 12, and having a closed end 17 that sits within the body of the bottle 11.

When the trigger spray 12 is manually actuated a pressure differential is established across the wall 18 of the dip tube 13 so that any liquid within the bottle in contact with any portion of the surface of the dip tube travels through the wall 18 of the dip tube 13 and thereafter along it's internal bore 19 to the outlet 16. This fluid dispenser is thereby capable of operating in substantially any orientation and is effective to dispense substantially the entire contents of the bottle.

One of the advantages of dispensing substantially the entire contents is that in some countries manufacturers are required by law to put more product and propellant in the container to compensate for the fact that in traditional containers there is often product left in the container at the end of its life. So for example, a container containing a stated amount of product of say 330 ml might actually have 350 ml. to allow for the fact that a traditional dip tube generally leaves around 20 ml in the container.

Hollow fibre membranes suitable for use as dip tubes 13 with the present invention are available commercially, for example X-flow (™) capillary membranes from Norit (www.norit.com) may be used.

Preferred dip tubes have a pore size in the range of 0.01 microns to 250 microns. The precise pore size, wall thickness, length, shape and configuration of the dip tube, internal bore, colour, and transparency can be selected according to the fluid to be dispensed and/or the propellant to be used, the resultant nature of the fluid once it is expelled i.e. the consistency of the foam, the fineness of the mist to be created, the degree of atomisation, the mix of propellant to product, and the nature of the container body in terms of size, shape, and colour.

The external diameter of the dip tube may be selected according to the internal or external diameter of the fluid port within the dispenser head or any other connecting body.

The hollow fibre membrane used to form the dip tube can be closed at one end by heat sealing/welding, crimping, gluing, chemical sealing, and ultrasonic or high frequency welding.

The hollow fibre membrane for the dip tube preferably comprises materials selected from the group consisting of polytetrafluoroethylene, polyamide, polyimide, polysulfone, polyethersulfone, polyvinylidene fluoride, polypropylene, polyvinyl chloride, polyvinyl pyrrolidone, polycarbonate, polyacrylonitrile, cellulose, cellulose acetate, mixtures, blends and co-polymers thereof.

Preferred hollow fibre membrane materials for the dip tube are selected from the group consisting of polysulfone, polyethersulfone, polyvinylidene fluoride, polyvinyl pyrrolidone, polyacrylonitrile, cellulose, cellulose acetate, mixtures, blends and co-polymers thereof.

A particularly preferred hollow fibre membrane material comprises a blend of polyethersulfone and polyvinylpyrrolidone. Polyethersulfone (PES) polyvinylpyrrolidone (PVP) blends are highly oxidant tolerant (>250,000 ppm hours for chlorine, tolerant to permanganate and ozone), are tolerant to wide pH range, and are highly hydrophilic.

The dip tube will preferably operate under a minimum operational pressure differential of at least 500 Pa. For high pressure systems the operational pressure differential may be as much as 1000 kPa.

Figure 2:
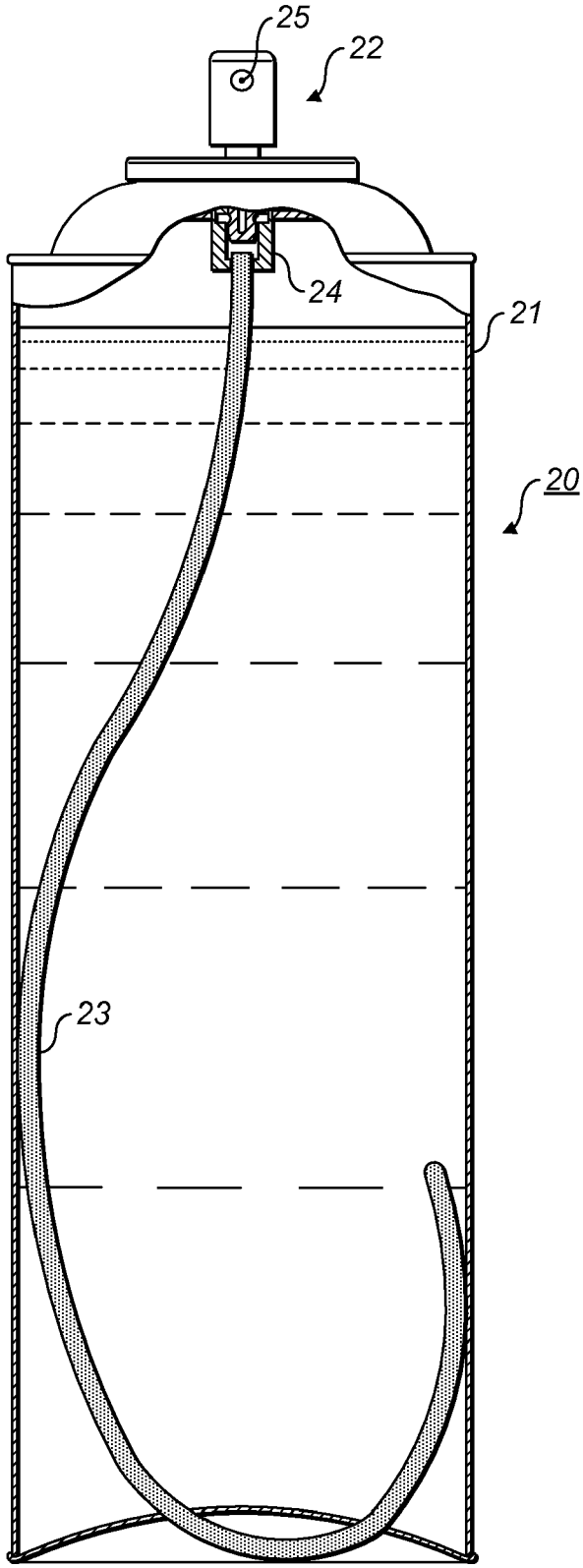
FIG. 2 shows an example of an aerosol spray canister.

FIG. 2 shows another example of a fluid dispenser 20 in accordance with the present invention. In this example the container is a conventional aerosol spay canister 21 having a conventional aerosol push-button spray head 22, but with a dip tube 23 formed from a hollow fibre membrane having an open end which is coupled to a fluid port 24 in the aerosol dispenser head so as to be able to communicate with the outlet 25, and having a closed end that sits within the body of the spray canister.

The spray canister 21 is self pressurised, containing a suitable propellant in addition to a fluid to be dispensed. The propellant creates a pressure differential so that when the push-button is manually actuated any liquid within the bottle in contact with any portion of the surface of the dip tube 23 travels through the wall of the dip tube and thereafter along it's internal bore to the outlet 25. This spray canister operates in substantially any orientation and is effective to dispense substantially the entire contents of the canister. If the propellant used is a liquefied gas then in its liquid state the propellant will also be dispensed.

Figure 3:
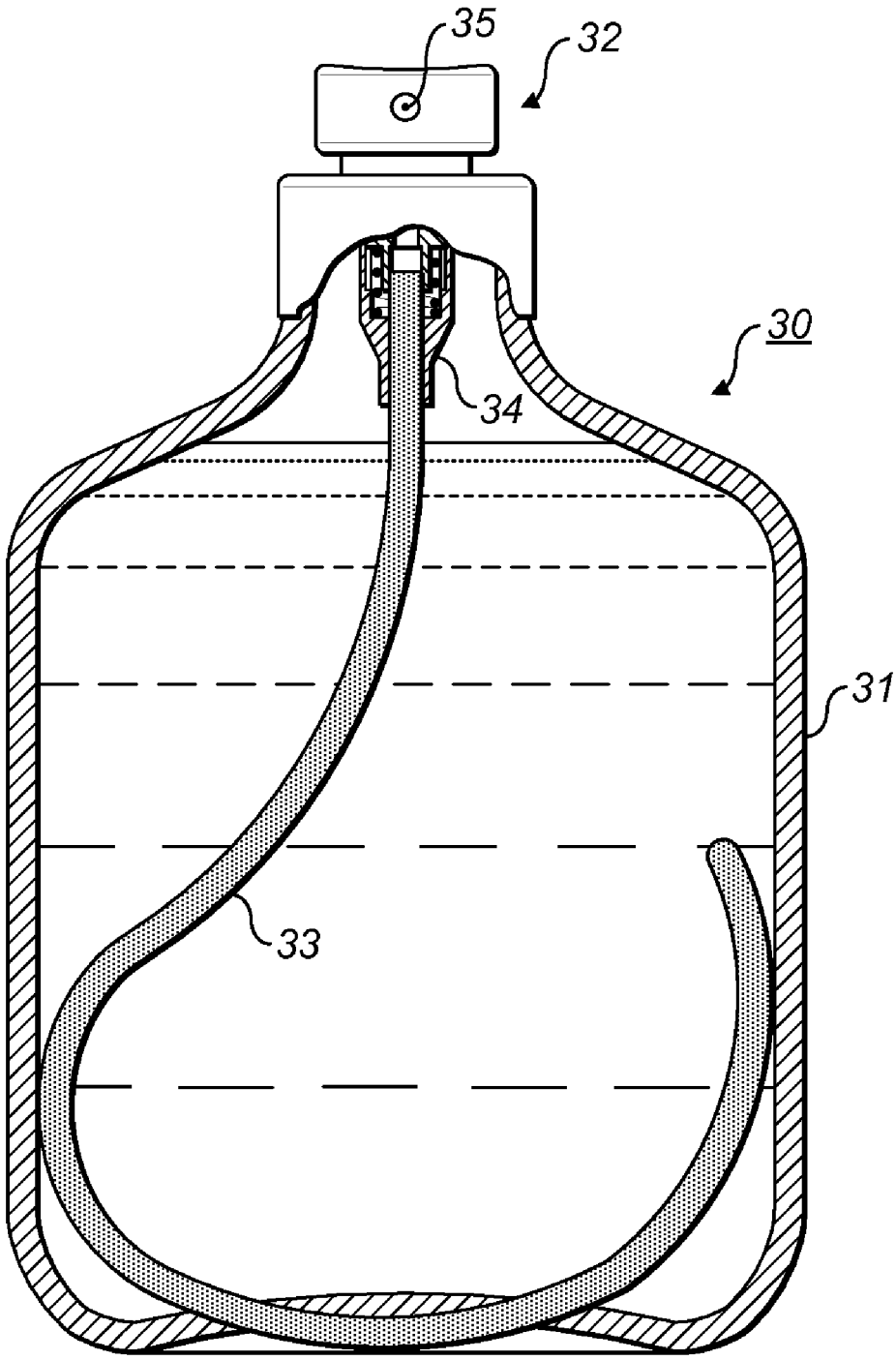
FIG. 3 shows an example of a perfume dispenser.
Figure 4E:
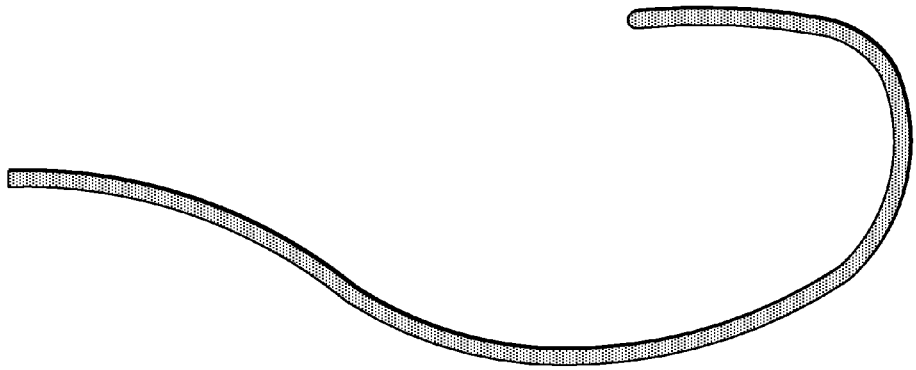
FIGS. 4A to 4E show side views of a hollow membrane dip tube in various configurations; and, FIGS. 5A and 5B show a collapsible container
Figure 4D:
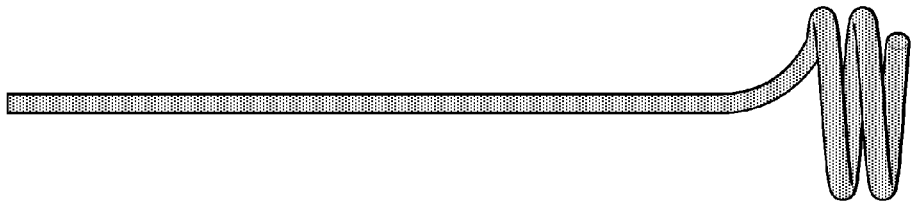
Figure 4C:
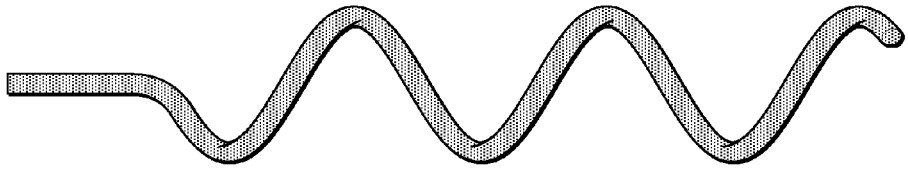
Figure 4B:
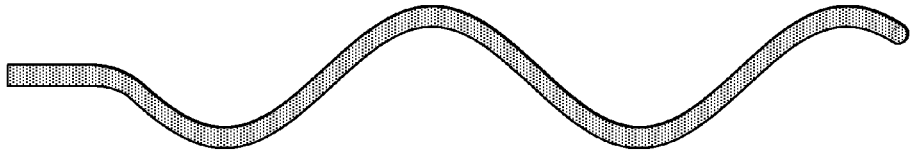
Figure 4A:
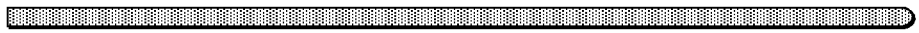

FIG. 3 shows yet another example of a fluid dispenser 30 in accordance with the present invention. In this example the container 31 is a conventional perfume bottle having a conventional push-button atomiser head 32, but with a dip tube 33 formed from a hollow fibre membrane having an open end which is coupled to a fluid port 34 in the atomiser head so as to be able to communicate with the outlet 35, and having a closed end that sits within the body of the bottle.

When the push-button is manually actuated it creates a pressure differential across the walls of the dip tube 33. Any liquid within the bottle 31 in contact with any portion of the surface of the dip tube 33 travels through the wall of the dip tube 33 and thereafter along it's internal bore to the outlet 35. This perfume bottle operates in substantially any orientation and is effective to dispense substantially the entire contents of the bottle.

The dip tubes shown in the examples in FIGS. 1 to 3 are arranged to contact opposite sidewalls and the base of the respective containers to ensure as far as possible that liquid within the container is substantially always in contact with the dip tube irrespective of the orientation of the container. Nevertheless, other configurations are possible. The configuration of the dip tube within the container can also be chosen in dependence on the shape of the container and the contents to be dispensed. FIGS. 4A to 4E show some different dip tube geometries that may be useful.

Figure 5A:
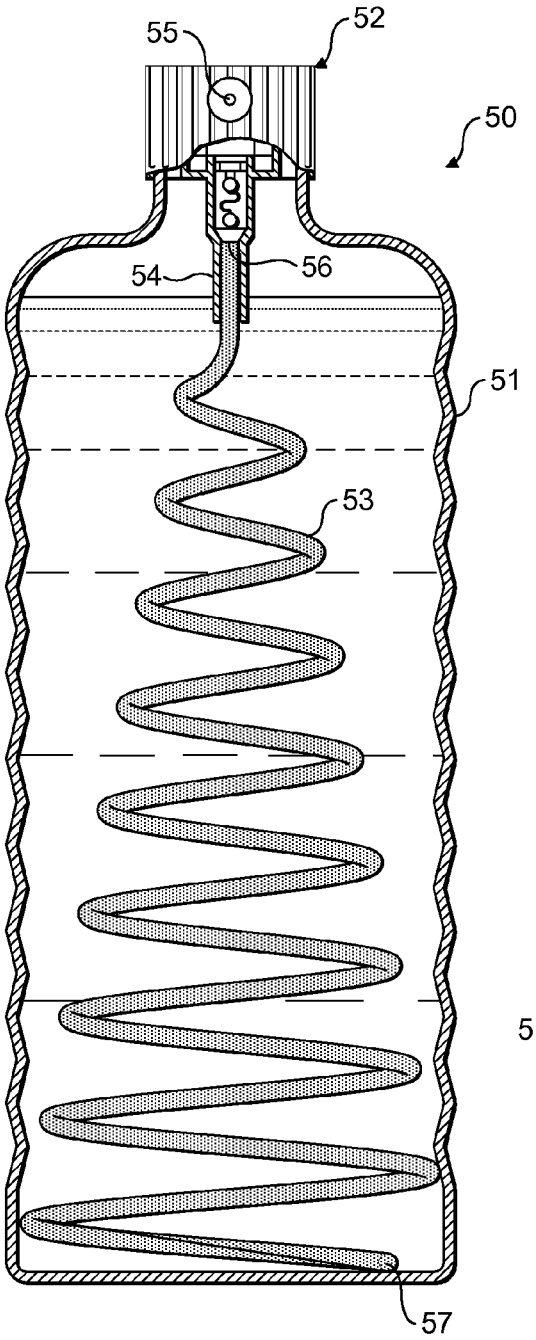
Figure 5B:
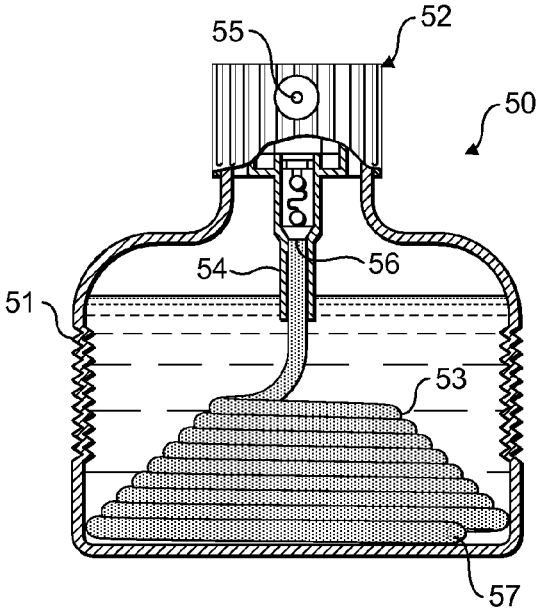

FIGS. 5A and 5B show a further example of a fluid dispenser 50 in accordance with the present invention. The side walls of the container 51 are concertinaed so as to be collapsible. FIG. 5A shows the fluid dispenser in an erected configuration whilst FIG. 5B shows the fluid dispenser in a collapsed configuration. This collapsible design is especially useful for reducing the storage and shipping volume of the container, which typically is manufactured in one country or location before being shipped elsewhere to be filled.

In this example the container 51 has a conventional push-button spray head 52, but with a collapsible spiral-shaped dip tube 53 formed from a hollow fibre membrane. The hollow fibre membrane dip tube 53 has an open end 56 which is coupled to a fluid port 54 in the aerosol dispenser head so as to be able to communicate with an outlet 55, and a closed end 57 that sits within the body of the container 51. In this example, the closed end 57 of the dip tube 53 is attached to the floor of the container 51 so that it deploys from its coiled state when the container side walls are extended.

Other collapsible configurations for the container and dip tube are possible depending on the shape of the container and materials used to form the side walls, in order to minimise the collapsed volume.

The fluid dispenser of the present invention is useful for dispensing many different fluids, including gels and foams.

The fluid dispenser can be used in many different applications including kitchen products, perfumes, deodorants and anti-perspirants, spray paints, hair products, liquid/foam/gel products, and insecticides. There are of course many others.

Typical dispenser heads known in the art include trigger spays, atomisers, aerosol sprayers, perfume sprayers, lotion pumps, foam pumps, inhalers and screw micro pumps. Any of these can be used with the hollow fibre membrane dip tube described above to put the present invention into effect. The dispenser head may eject fluid as a spray, stream, foam, fine-mist or gel.

Suitable containers include those made of plastics, glass, metals, ceramics, paper or composites. In some preferred embodiments the container may be provided with flexible walls so that when squeezed by hand a pressure differential is created sufficient to forced fluid through the wall of the hollow membrane dip tube to an outlet in the associated dispenser head.

Although in the above examples only one dip tube is provided, in some preferred embodiments more than one dip tube may be provided. The dip tubes may have the same material properties and performance. Alternatively, the dip tubes may be manufactured to perform differently, for example by varying the pore size, wall thickness, rigidity, shape, materials, coupling position and length.

The dip tube may be directly coupled to the dispenser head (as shown in the examples) or may instead be coupled indirectly to the dispenser head via another length of tubing.

The invention claimed is:

1. A fluid dispenser comprising:

a container for a liquid;

a dispenser head fitted to the container and having a fluid outlet; and, a dip tube formed from a length of hollow hydrophilic membrane, the hollow membrane having an open end which is coupled to the dispenser head so as to be able to communicate with the fluid outlet, and having a closed end that sits within the container, wherein the hollow membrane is adapted to pass liquid in preference to gas so that when the dispenser head is actuated the liquid travels from the liquid container through a wall of the dip tube to the fluid outlet under a pressure differential established across a wall of the membrane.

2. A fluid dispenser according to claim 1, wherein the dispenser head is actuable to establish the pressure differential to draw the liquid from the container.

3. A fluid dispenser according to claim 1, wherein the liquid container is self-pressurised.

4. A fluid dispenser according to claim 1, including a propellant.

5. A fluid dispenser according to claim 4, in which the propellant is a liquefied gas propellant.

6. A fluid dispenser according to claim 1, wherein the dispenser head is one of a trigger spray, atomiser, aerosol sprayer, perfume sprayer, lotion pump, foam pump, and a screw micro pump.

7. A fluid dispenser according to claim 1, wherein the dip tube is coupled directly to the dispenser head.

8. A fluid dispenser according to claim 1, in which the dip tube is indirectly coupled to the dispenser head.

9. A fluid dispenser according to claim 1, wherein the hollow membrane is arranged within the liquid container such that the hollow membrane is in communication with the liquid regardless of the orientation of the container.

10. A fluid dispenser according to claim 1, wherein the hollow membrane is flexible.

11. A fluid dispenser according to claim 1, wherein the hollow membrane extends substantially across an entire length of the liquid reservoir.

12. A fluid dispenser comprising:

a container for a liquid;

a dispenser head fitted to the container and having a fluid outlet; and, a dip tube formed from a length of hollow membrane, the hollow membrane having an open end which is coupled to the dispenser head so as to be able to communicate with the fluid outlet, and having a closed end that sits within the container, wherein the hollow membrane is adapted to pass liquid in preference to gas so that when the dispenser head is actuated the liquid travels from the liquid container through a wall of the dip tube to the fluid outlet under a pressure differential established across a wall of the membrane, in which the container and the dip tube are collapsible together between an erected configuration and a collapsed configuration.

13. A fluid dispenser according to claim 12, wherein the dispenser head is one of a trigger spray, atomiser, aerosol sprayer, perfume sprayer, lotion pump, foam pump, and a screw micro pump.

14. A fluid dispenser according to claim 12, wherein the dip tube is coupled directly to the dispenser head.

15. A fluid dispenser according to claim 12, in which the dip tube is indirectly coupled to the dispenser head.

16. A fluid dispenser according to claim 12, wherein the hollow membrane is arranged within the liquid container such that the hollow membrane is in communication with the liquid regardless of the orientation of the container.

17. A fluid dispenser according to claim 12, wherein the hollow membrane is flexible.

18. A fluid dispenser according to claim 12, wherein the hollow membrane extends substantially across an entire length of the liquid reservoir.

* * * * *